United States Patent [19]

Cohn

[11] Patent Number: 4,951,060

[45] Date of Patent: Aug. 21, 1990

[54] DUAL FREQUENCY TRANSMIT-RECEIVE MODULE FOR AN ACTIVE APERTURE RADAR SYSTEM

[75] Inventor: Marvin Cohn, Baltimore, Md.

[73] Assignee: Westinghouse Electric Corp., Pittsburgh, Pa.

[21] Appl. No.: 247,222

[22] Filed: Sep. 21, 1988

[51] Int. Cl.[5] ..... H01Q 3/26

[52] U.S. Cl. ..... 342/175; 342/372

[58] Field of Search ..... 342/193, 175, 368, 374, 342/372

[56] References Cited

U.S. PATENT DOCUMENTS 4,099,228 7/1978 Cohn .
4,160,975 7/1979 Steudel .
4,682,176 7/1987 Jones .
4,791,421 12/1988 Morse et al. .

*Primary Examiner*—Thomas H. Tarcza
*Assistant Examiner*—Mark Hellner

[57] ABSTRACT

An improved, dual frequency transmit-receive module operable for use with two harmonically related frequencies. This dual frequency transmit-receive module utilizing; a push-pull class B power amplifier having dual output ports, a standard frequency mixer and a harmonic mixer, is operable to transmit or receive an original frequency as well as a second harmonic of that same frequency, simultaneously or at distinct, discrete intervals. This improved dual frequency transmit-receive module is operable in any radar system, using only one, or a multiplicity of antennas. However, this transmit-receive module has specific application to active aperture radar systems utilizing one antenna means for each individual transmit-receive module in an active antenna array.

12 Claims, 8 Drawing Sheets

DUAL FREQUENCY TRANSMIT-RECEIVE MODULE FOR AN ACTIVE APERTURE RADAR SYSTEM

BACKGROUND OF THE INVENTION

1. Field of the Invention

The present invention is a dual frequency, transmit-receive module for use in any radar system. This dual frequency transmit-receive module enables the radar system to transmit or receive a radio frequency signal of an original, predetermined, frequency $f_o$ and a second harmonic signal $2f_o$, that is two times that of the original frequency. This novel transmit-receive module although operable in any radar system, has particular applicability to active aperture radar systems, wherein one antenna is used for each transmit-receive module signal transmission and/or reception.

2. Description of the Prior Art

The present invention relates generally to the field of radio frequency transmitting and receiving systems and more particularly to systems which, such as active aperture radar systems utilize a common antenna for each transmit-receive module.

A radar system in its simplest configuration is a remote location, radio frequency transmission and receiving means used to ascertain the distance and size of targets located in the environment outside of the radar system.

The target acquisition system operates through the transmission and return reflection of, a radio frequency signal of predetermined frequency. This amplified, pulsed, signal of predetermined frequency is first; generated by a frequency generator, driven by a pulsed modulator and amplified by an amplifier where it then transmitted to a single, mechanically steered antenna by means of a duplexer. The radar system duplexer serves to maintain signal separation between transmitted signals of a predetermined frequency and the received reflected signals which bounce off of the targets and return to the single, mechanically steered, physically sweeping antenna. The received reflected signals first enter the "front end", or low noise amplifier, which determines the signal sensitivity. These received target reflected signals finally reach a signal processor, wherein the distance and the size of the target reflecting the transmitted signal $f_o$ is ascertained.

The above-described radar system is well known in the prior art and has been traditionally designed *in either* the broadband or narrow band frequency range.

An important variation of this standard radar system and also well known in the art is the electronically scanned antenna radar system which utilizes an array of individual antenna elements, whose phase is controlled so that the beam formed by the array is electronically steered.

In such an electronically scanned radar system, the composite array, composed of many antenna elements, is no longer physically, mechanically steered or scanned from one position to another. The electronically steered system contains a manifold which is operable to split the single signal of predetermined frequency into a multiplicity of signals. Each one of these individual unaltered signals is then phase shifted through individual phase shifters a specified, predetermined phase difference. These individual phase shifters then transmit the shifted signals through individual, arrayed antennas, wherein each antenna element transmits uniquely each phase shifted signal. The reflected, received signals from various targets, again of the same predetermined transmitted frequency return via a receiving manifold into a common receiver.

An active aperture radar system in its most elementary form comprises; a signal generator operable to produce a signal of predetermined frequency, $f_0$, a manifold, operable to split this single signal $f_o$ into a multiplicity of signal paths while maintaining the predetermined frequency, a transmit-receive module for each signal path and an antenna element which is operable to both transmit or receive the signal $f_o$ for each transmit-receive module.

The received, reflected signal $f_o$, in the standard active aperture radar system, can never be a harmonic of the original signal $f_o$. Nor can the prior active aperture radar system transmit a second harmonic $2f_o$ of signal $f_o$. The active aperture radar system is a more complex system than the passive, electronically steered radar system. However, the active aperture system has less insertion loss resulting in greater transmitter efficiency and greater receiver sensitivity plus the advantage of multiple redundancy.

If one transmit-receive module, or one antenna of an array of these active aperture elements fails, the entire radar system remains functional. Radar system downtime is therefore greatly reduced. To date, in the design of active aperture radar system transmit-receive modules engineers have been restricted to the design of; either high power, narrow band, transmit-receive modules or, low power wide band transmit-receive modules. Wide-band, low power, designs are inherently inefficient.

The problem to be solved then is the development of a dual band capability for the transmit-receive module of a radar system, specifically an active aperture radar system. The preferred embodiment of this invention would provide dual band capability in the transmission and reception of a radio frequency of a predetermined frequency without the efficiency penalties of a wide-band low power design.

SUMMARY OF THE INVENTION

In accordance with the above requirements, the present invention, an improved dual frequency transmit-receive module is disclosed which while operable in a multiplicity of radar system applications is uniquely suited to incorporation in an active aperture radar system.

This dual frequency, transmit-receive module, fully utilizes existing common components of the active aperture radar system with; a push-pull Class B amplifier having dual output ports, and standard and harmonic mixers. Dependent upon system noise level requirements, dual frequency transmit-receive module embodiments presented include three alternative designs for the reception mode; (a) no low noise amplifier, if the higher noise level of a mixer as the first element of the receiver path can be tolerated, (b) two separate and distinct low noise amplifiers, one for the original frequency $f_o$, and the other for the second harmonic $2f_o$, of that frequency, when noise must be maintained at a minimum, and (c) one, single, broadband low noise amplifier which is operable for use with the original frequency and the second harmonic of that frequency if an intermediate noise level can be tolerated by the entire radar system.

An active aperture radar system incorporating this dual frequency transmit-receive module is also disclosed.

BRIEF DESCRIPTION OF THE DRAWINGS

For a better understanding of the invention, reference may be had of the preferred embodiment exemplary of the invention shown in the accompanying drawings, in which.

DESCRIPTION OF THE PREFERRED EMBODIMENTS

Figure 1B:
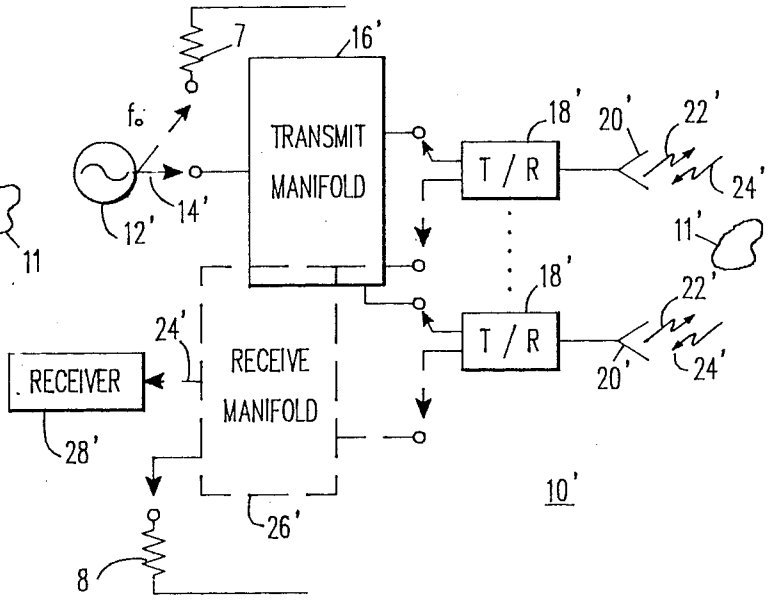
FIG. 1B PRIOR ART
FIG. 1B is a block diagram of the functional components necessary for a prior art, active aperture radar system, utilizing separate transmit and receive manifolds.
Figure 1A:
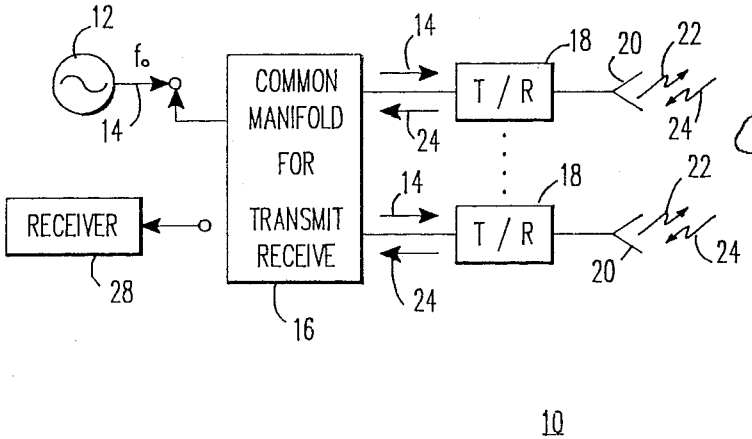
FIG. 1A PRIOR ART
FIG. 1A is a block diagram of the functional components necessary for a prior art, active aperture radar system, utilizing a common manifold.

FIG. 1A is a block diagram of the functional components necessary for a prior art, active aperture radar system 10, having a common manifold for transmit and receive. A stalo, or frequency generator 12, is operable to produce a stable, continuous transmission signal 14 of a predetermined frequency, $f_o$. This continuous transmission signal 14, enters a common manifold for transmit or receive 16. The common transmit and receive manifold 16 is operable to split this continuous transmission signal 14 into a multiplicity of signals 14, without changing the predetermined frequency or signal strength. Each of these individual signals 14 enters a transmit-receive module 18. Each transmit-receive module 18 is operable to transmit each input signal 14 as an output signal, 22 via a distinct and separate antenna 20 to the environment outside of the active aperture radar system 10 toward a target 11. The target 11 reflects the antenna 20 output signal 22 back towards the antenna 20 as reflected input signal 24. The received reflected signal 24 enters the common manifold 14 where it is combined with all of the received reflected signals, 24 and then this combined signal 24 enters to a receiver 28 for analysis.

FIG. 1B is a block diagram of the functional components necessary for a prior art, active aperture radar system 10', having a separate transmit and separate receive manifold. Frequency generator 12', is operable to produce a stable, continuous transmission signal 14', of predetermined frequency, $f_o$. This continuous transmission signal 14', enters a transmit manifold 16'. The transmit manifold 16' is operable to split this continuous transmission signal 14' into a multiplicity of signals 14', without changing the predetermined frequency or signal strength. Each of these individual signals 14' enters the various transmit-receive modules 18'. Each transmit-receive module 18' is operable to transmit each input signal 14', as an output signal, 22', via a distinct and separate antenna 20' to the environment outside of the active aperture radar system toward a target 11'. The target 11' reflects the antenna 20' output signal 22' back towards the antenna 20' as reflected input signal 24'. The received reflected signal 24' enters the transmit-receive module 18' where it is directed to the receive manifold 26'. The receive manifold 26' is operable to receive each reflected input signal 24' and combine these signals 24' to a single signal which is directed to and analyzed by the receiver 28'. When the prior art, active aperture radar system 10' is in the transmit mode the frequency generator connects to the transmit manifold 16'. However, when the system 10' is in the receive mode, the frequency generator connects a "dummy" resistor or load resistor 7. When the system 10' is in the receive mode of the receive manifold 26' connects to the receiver 28'. However, when the system 10' is in the transmit mode, the receive manifold 26' will connect to the "dummy" resistor or load resistor 8.

Figure 2:
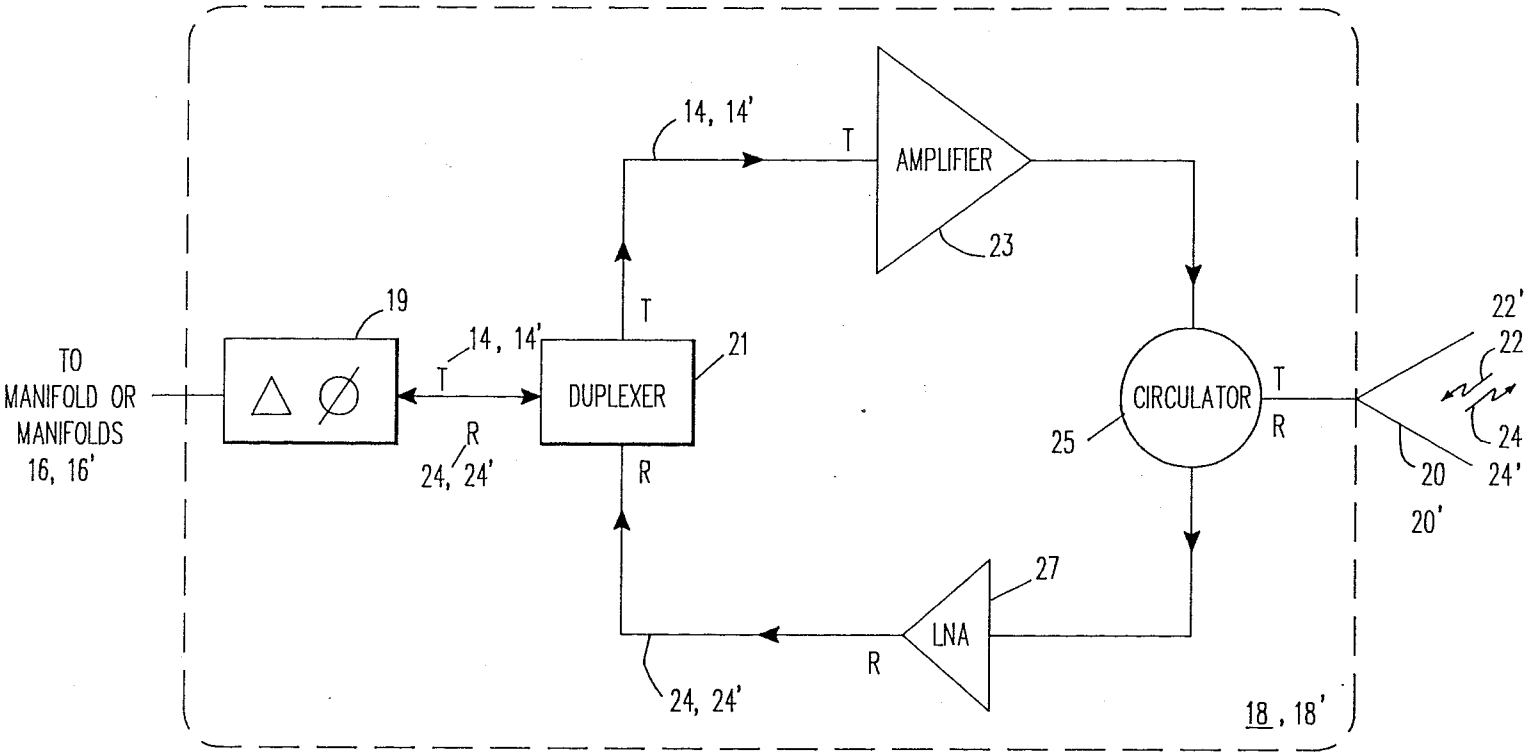
FIG. 2 PRIOR ART
FIG. 2 is a block diagram of the functional components necessary for the transmission and reception of a radio frequency signal in a prior art active aperture radar system; specifically the transmit-receive module.

FIG. 2 is a block diagram of the functional components necessary for the transmission and reception of a radio frequency signal in a prior art active aperture radar system 10 or 10', specifically the transmit-receive module 18 or 18'. This transmit-receive module 18 or 18', is well known in the prior art and receives its transmission signal 14, 14' from the common or individual transmit manifolds 16, 16'. The transmit-receive module 18, 18' is operable to phase shift this received signal 14, 14' amplify it and while in the transmission mode send this signal 14, 14' out of the antenna 20, 20' into the environment outside of the radar system as output signal 22, 22'. Phase shifter 19 is operable to receive signal 14, 14' from the common or individual transmit manifolds 16, 16'. The phase shifter 19 is further operable to phase shift that signal 14, 14' a predetermined amount. The duplexer 21 shown in FIG. 2 receiving the phase shifted signal 14, 14' from the phase shifter 19 is necessary if only one phase shifter 19 is used for both the transmit and receive modes. The duplexer 21 protects the sensitive receiver 28 circuitry as shown in FIGS. 1A and 1B, from the powerful transmitter output by isolating the receiver 28 during the signal 22, 22' transmission. Also, the duplexer 21, isolates the transmit-receive module 18, 18' from the receiver 28 as shown in FIGS. 1A and 1B, when the transmit-receive module is off to prevent loss of weak returning, echo signals 24, 24'. An amplifier 23 amplifies the signal 14, 14' received from the duplexer 21 sufficiently, isolating signal 14, 14' for transmission. During the transmit mode, circulator 25 directs the transmitted signal to the antenna while isolating and hence protecting the sensitive low noise amplifier from the relatively high power transmitted signal. When the transmit-receive module is in the receive mode, the circulator 25 directs all of the low level receive signal 22 to the low noise amplifier.

As also shown in FIG. 2, a reflected, received signal 24, 24' reflected from a target 11, 11' outside of said active aperture radar system 10, 10' passes through a low noise amplifier 27 upon entering the transmit-receive module 18, 18' through antenna 20, 20'. The low noise amplifier 27 maintains an acceptable signal-to-noise ratio for the transmit-receive module 18, 18' before the received, reflected signal 24, 24' passes through duplexer 21 and phase shifter 19.

Finally, as shown in FIG. 2, the received, reflected signal 24, 24' is noise controlled by the low noise amplifier 27 and phase shifted by the phase shifter 19 and is directed into a common receiver manifold 16, where it is combined with all of the received signals 24, 24' which have been received by the multiplicity of transmit-receive modules 18, 18'.

The transmit-receive module 18, 18' as shown in FIG. 2, and as well known in the prior art, is operable in one frequency only for the transmit and receive signals, 14, 14' and 24, 24' respectively. The designer of this transmit-receive module 18, 18' is therefore severely limited as to its performance. The design for this prior art, transmit-receive module 18, 18' is inherently limited, dependent upon the type of amplifiers used in the transmit and receive modes such as; a high power narrow band transmit-receive module, or an inefficient low power wide band transmit-receive module.

Figure 3A:
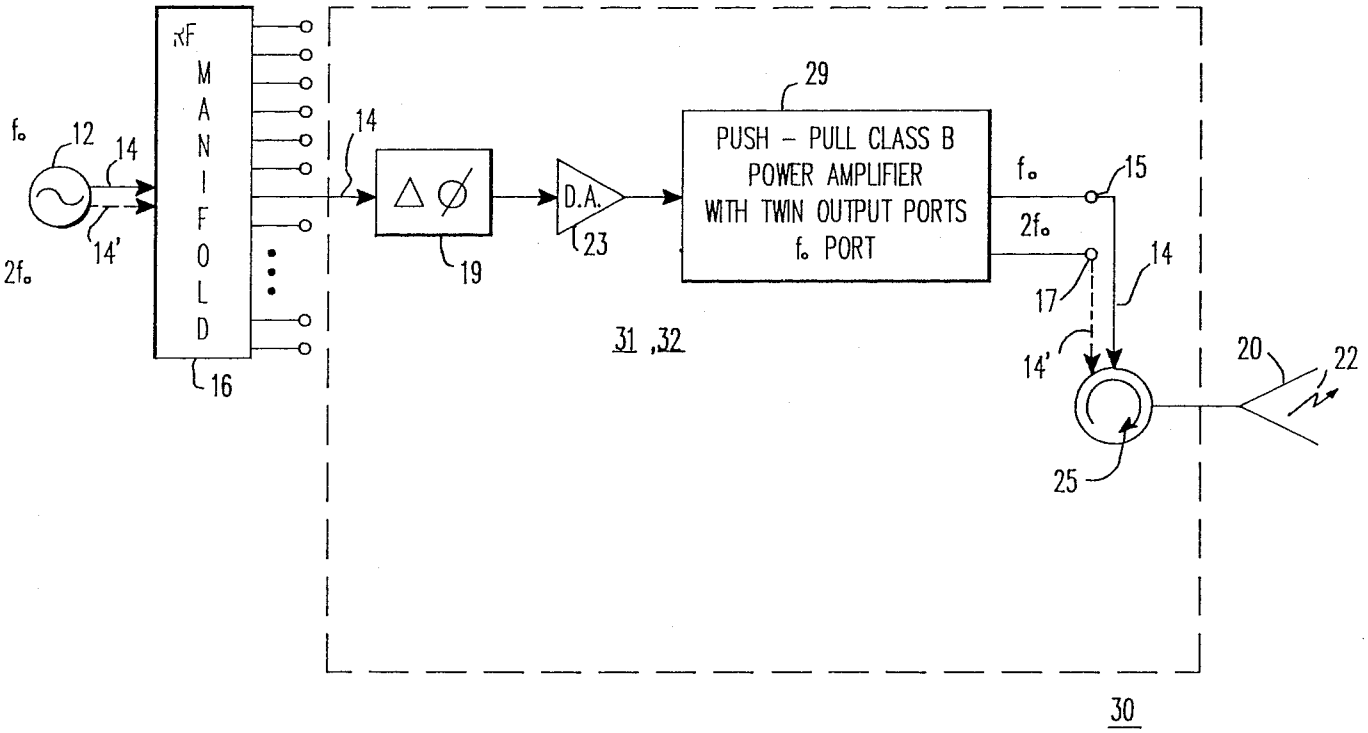
FIG. 3A is a block diagram of the functional components of a transmission mode of a novel dual frequency transmit-receive module for two harmonically related frequencies of an active aperture radar system, specifically; when the dual frequency transmit-receive module is in the transmit mode for an original predetermined frequency, $f_o$.

FIG. 3A is a block diagram of the functional components of a first transmission mode of a dual frequency transmit-receive module 30 where the signal transmitted is at original frequency, $f_o$. FIG. 3A is a block diagram of an original frequency transmission mode for an original signal 14 having a predetermined frequency, $f_o$. A signal generator 12, produces this continuous, stable transmission signal 14 having predetermined frequency, $f_o$. This single signal 14 then enters an RF transmission manifold 16 which is operable to split this signal 14 into a multiplicity of individual signals, 14, while maintaining the original single signals' frequency. One individual signal 14 enters a transmission mode 31 of the novel dual frequency transmit-receive module 30. Phase shifter 19, then shifts the phase of signal 14 a predetermined amount. This phase shifted signal 14 enters driver amplifier 23 wherein the amplitude of the signal 14 is increased. A push-pull Class B power amplifier 29 having twin output ports 15 and 17, and operable at the original frequency $f_o$ for signal 14 as well as a second harmonic of that signal 14' amplifies the signal 14 and directs that signal 14 to circulator 25 via output port 17. In an original frequency transmission mode, circulator 25 receives the signal 14 from the original frequency output port 15 of the push-pull Class B power amplifier 29 and directs signal 14 to antenna 20 where this signal 14 exits the transmit-receive module 30 and the active aperture radar system 10 as transmitted output signal 22, again at original frequency $f_o$.

Also shown in FIG. 3A is a block diagram of the functional components of a second transmission mode 32, the second harmonic transmission mode for the novel, dual frequency transmit receive module 30. Second harmonic ($2f_o$) transmission mode 32 comprises all of the commonly used components which are also operable to function in the transmission mode 31 for original frequency, $f_o$ and, in harmonic mode 32, single transmission signal 14', a second harmonic ($2f_o$) of the original frequency, $f_o$ is substituted for signal 14.

Figure 3B:
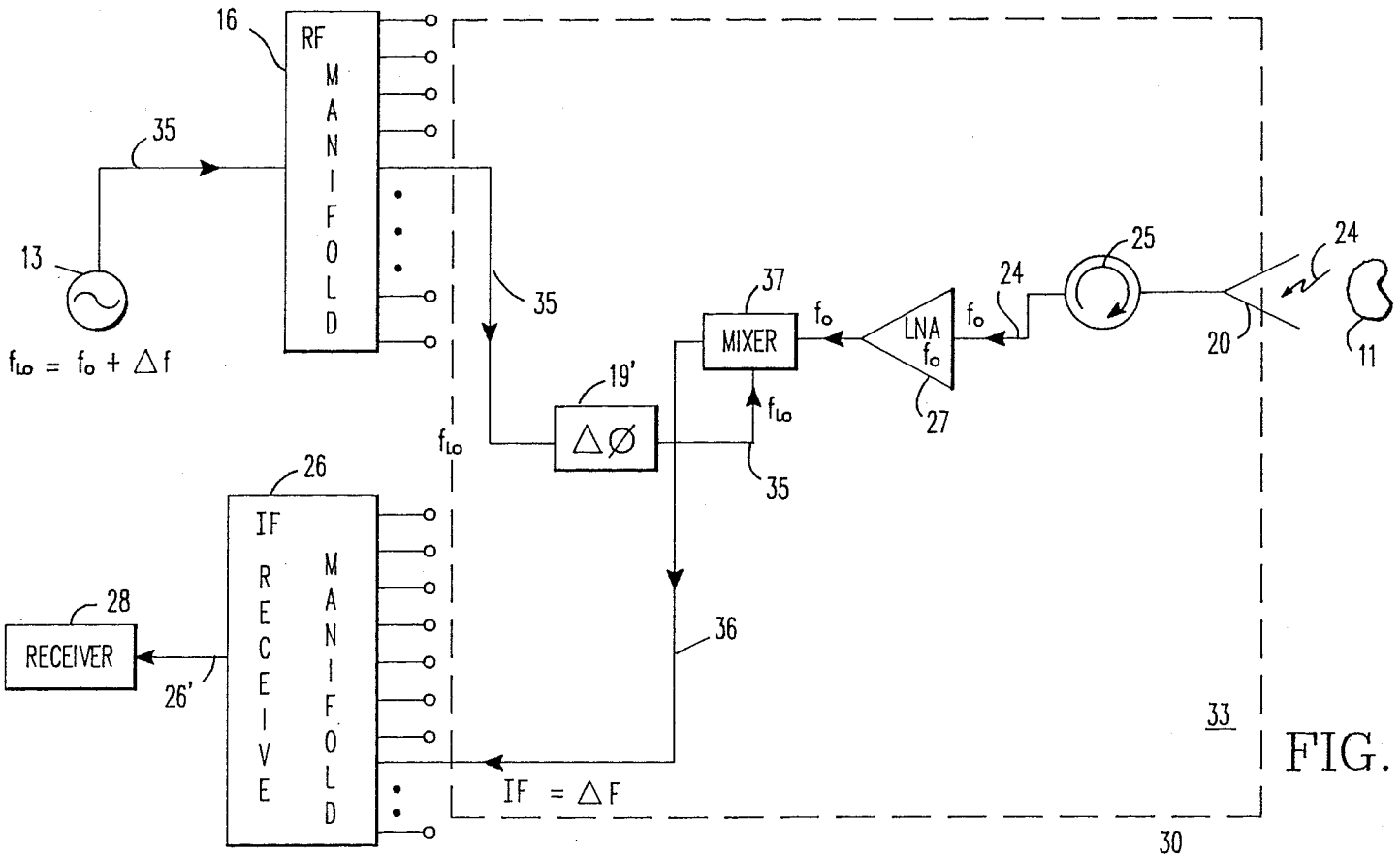
FIG. 3B is a block diagram of the functional components of a receive mode of a novel dual frequency transmit-receive module for two harmonically related frequencies of an active aperture radar system, specifically; when the dual frequency transmit-receive module is in the receive mode for the original predetermined frequency $f_o$.

A first reception mode 33 for the novel dual frequency transmit-receive module 30, is operable with a reflected received signal 24 for the original signal 14 having a predetermined frequency, $f_o$ as shown in block diagram, FIG. 3B. The reflected, received signal 24 enters the reception mode 33 via antenna 20. A circulator 25 maintains transmission and reception signal separation for the transmit-receive module 30. In this preferred embodiment of the disclosed invention, the reflected received signal 24 first passes through low noise amplifier 27. The low noise amplifier 27 causes the receive noise figure to be low. The low noise amplifier 27 can be eliminated if the higher noise figure of the mixer 37 alone can be tolerated. If a moderate high level of noise can be tolerated in the received reflected signal 24 of an original predetermined frequency $f_o$, then this reception mode 33 for the novel dual frequency transmit-receive module 30 can be designed without the low noise amplifier 27. If a moderate amount of noise can be tolerated by the system, then a single broadband low noise amplifier could handle the noise level requirements for the received, reflected signals 24 at an original frequency $f_o$ as well as at the second harmonic $2f_o$ of the original frequency $f_o$. Finally, if the noise level of the received, reflected signal 24 must be maintained to a specified minimum level, then an individual low noise amplifier 27 must be used for both the reception mode 33 for the original signal $f_o$ and the reception mode 34 for the second harmonic $2f_o$ of that original signal, $f_o$.

The reception mode 33 of the original signal 22 as received as a reflected signal 24 from the environment outside of the active aperture radar system 10 further contains a mixer 37 which is operable to combine two distinct signals 35 and 24, resulting in a third intermediate signal, 36. The mixer 37 is driven by a local oscillation frequency generator 13 in the reception mode 33. A local oscillation frequency 35 is generated from the original signal $f_o$ plus a predetermined change in frequency $\Delta f$. When the original signal $f_o$ is received as a reflected signal 24 through the antenna 20 from a target 11 outside of the active aperture radar system, a local oscillation frequency generator 13 produces a single, local oscillating signal 35 which then passes through a transmitting manifold 16. In a second harmonic mixer the received signal at a frequency $2f_o$ mixes with the second harmonic of the LO frequency $f_{LO}=f_o+\Delta f$, resulting in an IF frequency of $2\Delta f$. Additionally, the phase shifter only has to shift through a range of 180° because in second harmonic mixing that is the equivalent of a 360° phase shift in fundamental mixing. The transmitting RF manifold 16 splits this single signal 35 into a multiplicity of local oscillation signals 35, one individual signal for each mixer 37 which is receiving the reflected signal 24. This local oscillation frequency 35 is phase shifted by phase shifter 19' prior to entering mixer 37. The mixer 37 combines the received reflected, noise reduced signal 24 and the local oscillation frequency 35 to generate an intermediate signal 36. The intermediate signal 36 is combined in an IF reception manifold 26 with all of the signals 36 from all of the novel dual frequency transmit-receive modules 30. A single signal 26' the result of combining all of the individual intermediate signals from all of the mixers 37 is then transmitted to the receiver 28.

Figure 3C:
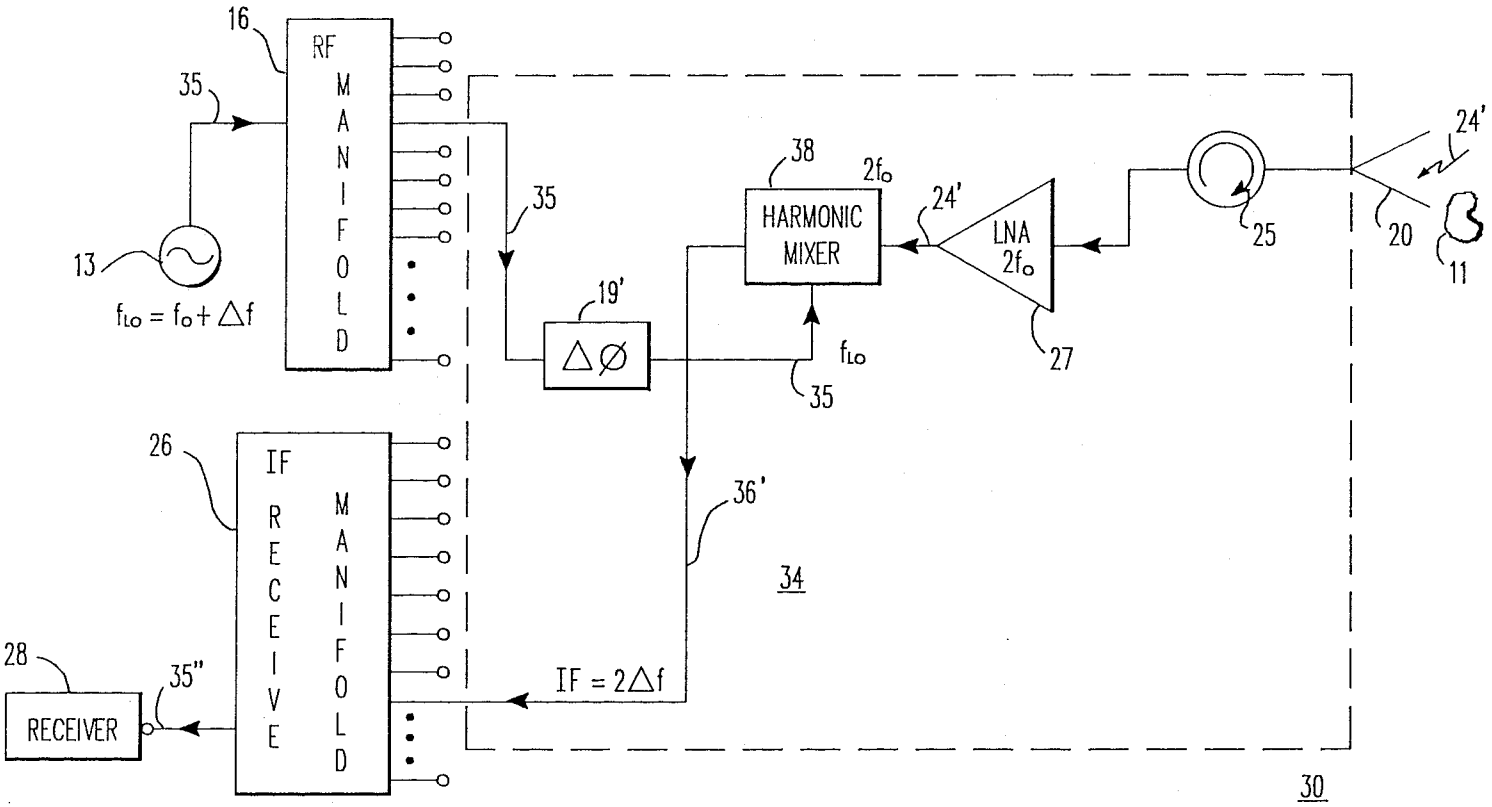
FIG. 3C is a block diagram of the functional components of a receive mode of a novel dual frequency transmit-receive module for two harmonically related frequencies of an active aperture radar system, specifically; when the dual frequency transmit-receive module is in the receive mode and is operable to receive a second harmonic of original frequency $f_o$, $2f_o$.

In FIG. 3C a reception mode 34 is shown for a second harmonic signal $2f_o$ for the original signal $f_o$. A second harmonic reflected signal 24' is received from a target 11 outside of the active aperture radar system 10. This signal enters through antenna 20 where circulator 25, in the reception mode directs the signal $2f_o$, into a low noise amplifier 27. As previously described, the presence or absence of a low noise amplifier 27 will depend upon the noise requirements designed into the radar system 10. In this embodiment of a reception mode 34 for the dual frequency transmit-receive module 30 an individual low noise amplifier 27 is shown for the second harmonic received signal 24'. A harmonic mixer 38 is operable to receive this second harmonic signal 24' of the original signal $f_o$ and is further operable to combine a local oscillation frequency 35 as generated by a local oscillation frequency generator 13 with the reflected, received signal 24'. A phase shifter 19', shifts the phase of the local oscillation frequency 35 prior to its combination with the received signal 24'. An intermediate signal 36' is generated by the combination of the local oscillation signal 35 and the received signal 24'. This intermediate signal 36 is combined by a receiver manifold 26 with all of the received signals into a single, signal 35''. This single combined signal 35'' is finally sent to the receiver 28 for analysis.

Figure 4:
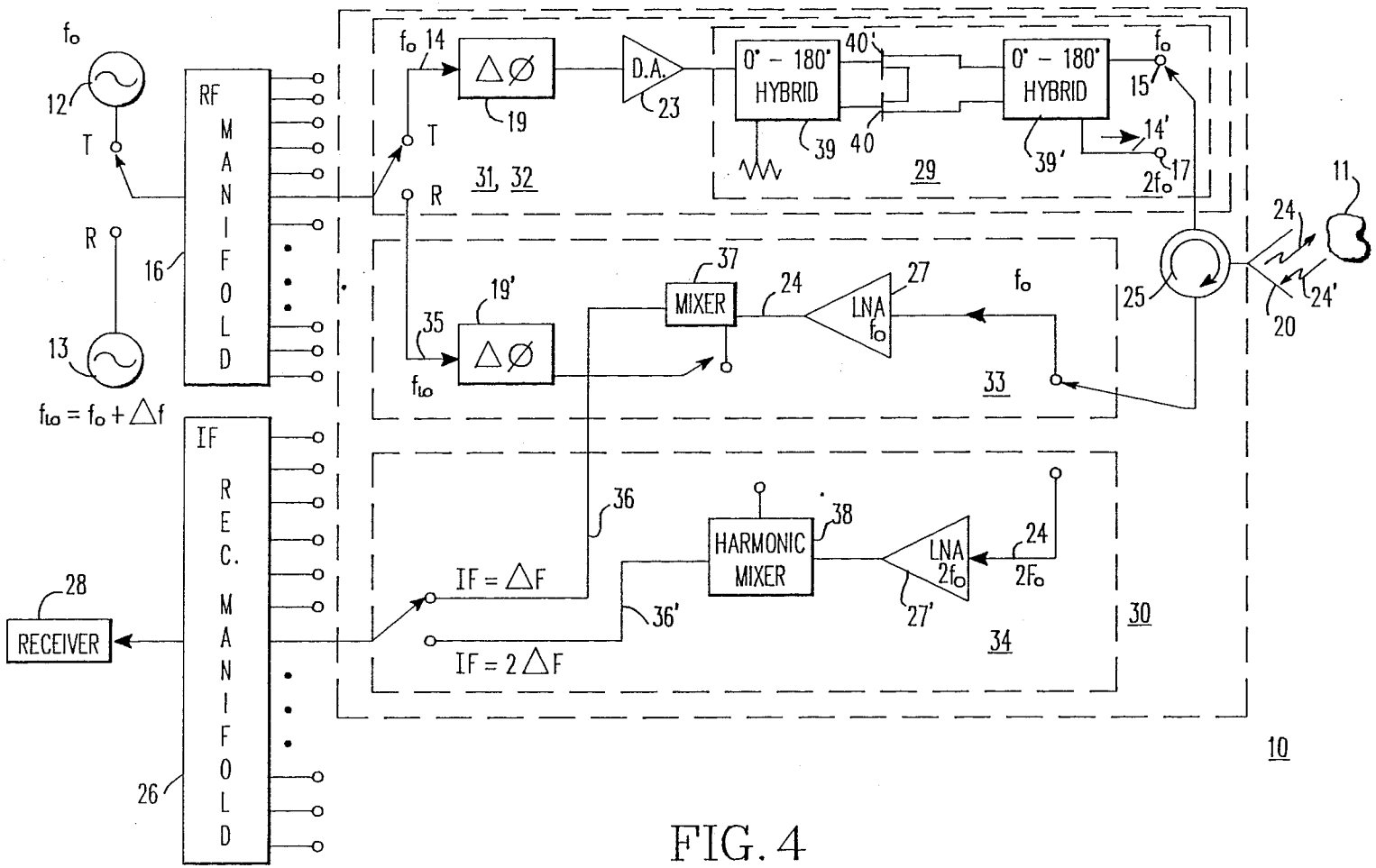
FIG. 4 is a block diagram of the functional components of both transmit modes and both receive modes for a novel dual frequency transmit-receive module operable for two harmonically related frequencies.

FIG. 4 is a block diagram of the novel dual frequency transmit-receive module 30 as it could be used in any radar system, but with particular application to an active aperture radar system 10 as described in FIG. 1. This dual frequency transmit-receive module 30 comprises two distinct transmitting modes, 31 and 32 and two distinct reception modes 33 and 34 dependent upon the whether the signal is of the original frequency $f_o$ or the second harmonic $2f_o$ of that frequency. The transmitting modes 31 and 32 share; a frequency generator 12, a transmit manifold 16, a phase shifter 19, a driver amplifier 23 and a push-pull Class B dual output port power amplifier 29. The reception modes 33 and 34 share; a local oscillator signal generator 13, an RF transmit manifold 16, a local oscillator phase shifter 19' an IF receiver manifold 26 and a receiver 28. Both the transmitting modes 31 and 32 and the receiving modes 33, and 34 jointly share the circulator 25 and the common antenna 20. The second harmonic reception mode 34 is distinct from the original signal reception mode 33 in that the second harmonic reception mode 34 utilizes a harmonic mixer 38, instead of a mixer 37 as a signal combination means. In the embodiment described in FIG. 4 two distinct low noise amplifiers 27 and 27' are shown for the two reception modes 33 and 34 respectively. However, as previously described these low noise amplifiers 27 and 27' can be eliminated from the dual frequency transmit-receive module 30 design conditioned upon the level of noise acceptable to the overall system 10 parameters. This sharing of many of the system components results in an efficient, effective transmit-receive module 30 operable in a narrow band application as well as a more broadband harmonic construct.

In the dual frequency transmit-receive module 30 as shown in FIG. 4, the original signal $f_o$ and the second harmonic of that signal $2f_o$ may be transmitted simultaneously or individually at discrete intervals. Further, a signal 24' reflected from a target 11, located in the environment outside of the active aperture radar system 10 may be of the original frequency $f_o$ or of the second harmonic of the original frequency. In either mode the reflected, received signal, 24' will be accepted by the dual frequency transmit-receive module 30 and processed by the shared components.

The dual frequency transmit-receive module 30 as described in FIG. 4 is operable to transmit a signal 14 having a predetermined frequency $f_o$ generated by a frequency generator 12. The signal 14 of an original frequency, $f_o$ is then split by the RF transmitter manifold 16 into a multiplicity of signals which are all operable to be transmitted by an equal number of transmit-receive modules 30. If an original frequency signal 14 is being transmitted, it is phase shifted a predetermined amount by a phase shifter 19, amplified by a driver amplifier 23 and power amplified by a push-pull Class B power amplifier 29. The push-pull Class B power amplifier 29 comprises; a first zero through one hundred-eighty degree hybrid 39, dual field effect transistors (FETS) 40, 40' and a second zero through one hundred-eighty degree hybrid 39'. The push-pull Class B power amplifier 29 has dual output ports 15 and 17 which are operable to transmit a signal 14 having an original frequency $f_o$ or that signals second harmonic $2f_o$, 14'. The signal passes through a circulator 25 which provides signal isolation for the transmit and receive modes 31,32 and 33, 34. Common antenna 20 finally transmits the signal, now 24 to the environment outside of the active aperture radar system 10.

In either reception mode, 33 or 34 the dual frequency transmit-receive module 30 is fully operable to receive and process a reflected, received signal, or 24' from antenna 20. As can be seen in FIG. 4, a common local oscillation frequency generator 13 and joint phase shifter 19' can be used in modes 33 and 34. The distinction between the reception modes then turns on whether it is necessary for the incoming signal 24' to be mixed by a standard mixer 37 (if the incoming signal is the original frequency $f_o$) or by the harmonic mixer 38 (if the incoming signal is a second harmonic $2f_o$ of the original signal $f_o$). Again, the low noise amplifiers shown in FIG. 4 as 27, and 27', are optional, dependent upon the design constraints of the overall system 10. However, in the reception mode 33 or 34, the mixers 37, 38 perform the same function; both mixers 37, 38 combine the local oscillation signal 35 from the local oscillation frequency generator 13 with the received, reflected signal 24 or 24' into an intermediate signal 36 or 36'. The intermediate signal 36 or 36' is combined within the reception manifold 26 with all of the other intermediate signals generated by all of the other transmit-receive modules 34 comprising the active aperture radar system 10. This single signal is then directed to the receiver 28 for analysis.

Figure 5:
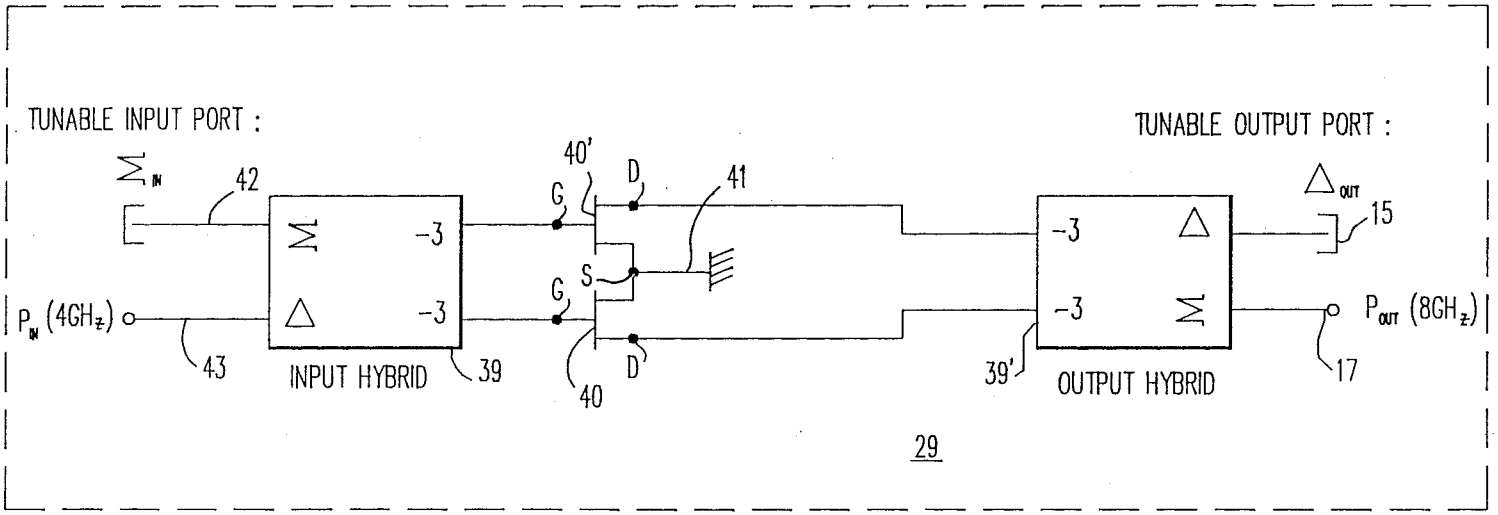
FIG. 5 is a block diagram of the functional components of a push-pull Class B Power Amplifier having, dual output ports operable for use in a dual frequency transmit-receive module; and, FIG. 6 is a graph of output power ($P_{out}$) versus input power ($P_{in}$) for a pair of Field Effect Transistors (FET) in a push-pull configuration for Frequency Doubling as a Function of the tuning of the input and output 0–180 degree hybrid junctions.

One of the critical components required to implement this dual frequency transmit-receive module 30 is the push-pull Class B power amplifier 29 as shown in FIG. 5. The four port hybrid junctions 39, 39' serve as signal separators analogous to a magic tee or rat race. A single input signal will be split between two output ports and isolated by the third. These hybrid junctions 39, 39' can be for example coaxial line, microstrip or rectangular wave guides. The output signals from the hybrid junctions 39, 39' are either in phase or out of phase and serve to feed the gates of the field effect transistors (FETS) 40, 40'. In Class B operation of the FETS, 40, 40' each FET generates a drain current waveform like that of a half wave rectified sine wave. This half wave rectified sine wave is very rich in even harmonics particularly the second harmonic. If the difference port 42 of the zero through one hundred and eighty degree hybrid junction 39 is used to excite the gates of a pair of FETS 40, 40' one hundred and eighty degrees out of phase, and a second junction 17 is used to collect the outputs from the drains of these FETS 40, 40', a push-pull configuration results. In such a push-pull configuration, separate output ports, 15 and 17 are available to extract the fundamental output 15 and the second harmonic output 17.

Figure 6:
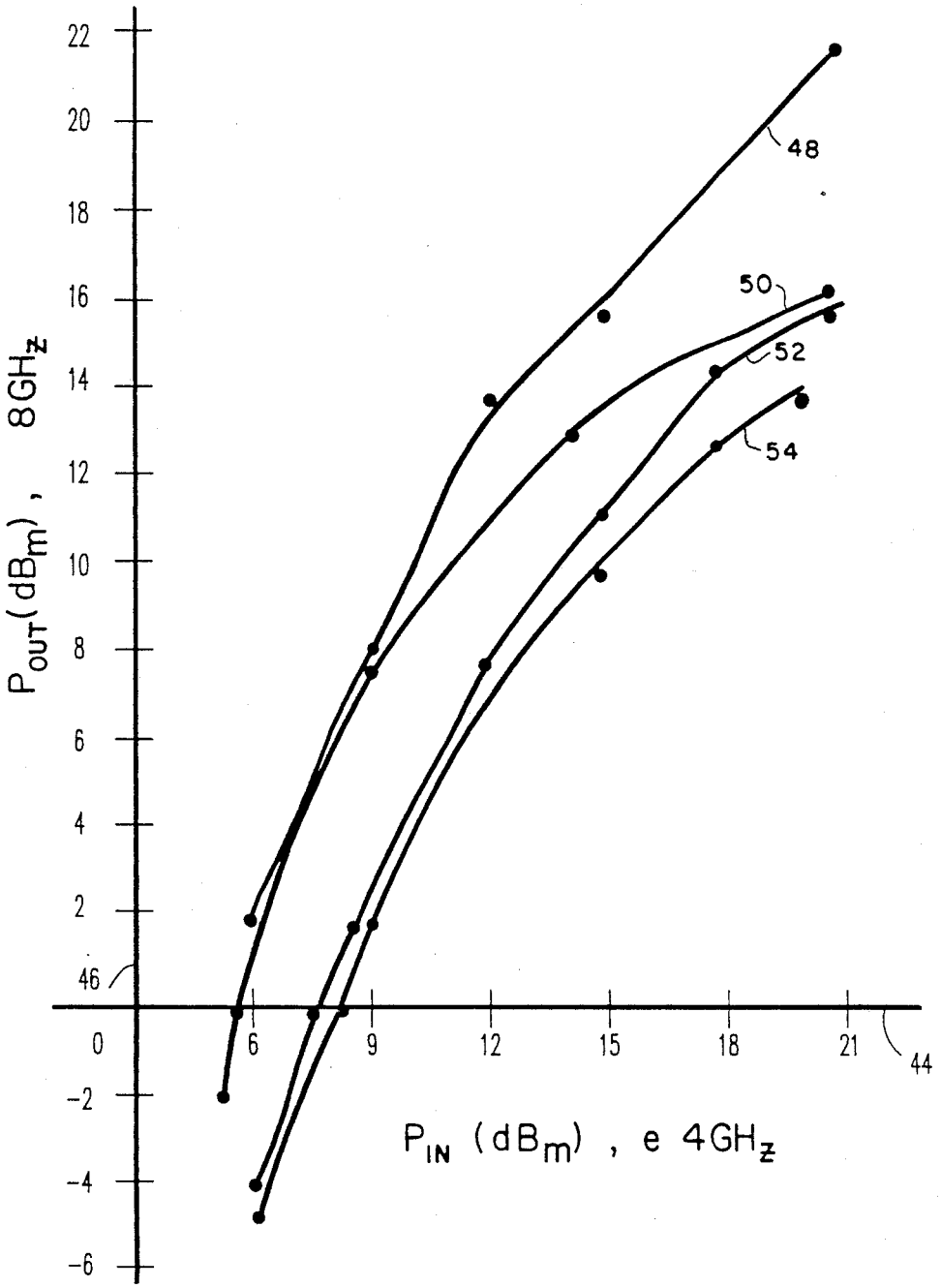

Experimental verification has been achieved for the second harmonic generation capability of the push-pull Class B power amplifier 29 for the range of from 4 to 8 GHz. A graph of the measured results is found in FIG. 6. In FIG. 6, the input power at 4 GHz is shown by ordinate 44. The output power of 8 GHz is shown by abscissa 46. The FET frequency doubling as a function of one hundred eighty degree hybrid junction port tuning is shown. Note that with the appropriate reactive tuning on the unused ports, the in phase or summation port 42 of the input hybrid junction and the out of phase or difference port 15 of the output hybrid a substantial increase of second harmonic output can be realized as seen by curve 48 over that obtainable with a resistive matched termination for each of these unused parts as seen by curve 54 as seen in FIG. 6. The curve 50 shows the effect when input port 42 is tuned and output port 15 is resistively terminated, while curve 52 shows the effect when output port 15 is tuned and input port 42 is resistively terminated.

Finally, the harmonic mixer 38 as shown in FIGS. 3C and 4, a critical component to the harmonic reception mode 34 of this dual frequency transmit-receive module 30, has been successfully demonstrated in a U.S. Pat. No. 4,O99,228 issued, July 4, 1978 to the inventor of this device, entitled "Harmonic Mixing with an Anti-Parallel Diode Pair".

Numerous variations may be made in the above-described combination, and different embodiments of this invention may be made without departing from the spirit thereof. Therefore, it is intended that all matter contained in the foregoing description and in the accompanying drawings shall be interpreted as illustrative and not in a limiting sense.

We claim:

1. A dual frequency transmit/receive module, said dual frequency transmit/receive module being so operable in the transmit mode as to phase shift and amplify an original and a harmonically related radio frequency signal, said dual frequency transmit/receive module being further operable in the receive mode to receive said received reflected original and said harmonically related radio frequency signal from a circulator means, said circulator means operable to separate and isolate said original and said harmonically related radio frequency signal as received or transmitted from said antenna means, comprising:

a transmission signal input port means, said transmission input port means being operable to receive from a transmission manifold said original or said harmonically related radio frequency signal;

a transmission signal phase shifting means, said transmission signal phase shifting means being operable to phase shift said original or said harmonically related radio frequency signal;

a driver amplifier means, said driver amplifier means being operable to amplify said original or said harmonically related radio frequency signal;

a dual port push-pull Class B power amplifier means, said dual port push-pull Class B power amplifier means being operable to amplify either said phase shifted original or said phase shifted harmonically related radio frequency signal;

a local oscillating signal input port means, said local oscillating signal input port means being operable to receive from an oscillating signal generator a local oscillating radio frequency signal;

a local oscillating signal phase shifting means, said local oscillating signal phase shifting means being operable to phase shift said local oscillating radio frequency signal;

a mixer, said mixer operable to combine said local oscillating radio frequency signal and said received reflected original radio frequency signal; and a harmonic mixer, said harmonic mixer operable to combine said local oscillating radio frequency signal and said received reflected harmonically related radio frequency signal.

2. A active aperture radar system, said active aperture radar system being operable to generate, transmit and receive an original radio frequency signal having a predetermined frequency, and said active aperture radar system being further operable to generate, transmit and receive a second harmonic of said original radio frequency signal simultaneously with said original radio frequency signal, or consecutively with said original radio frequency signal, comprising:

a frequency generating means, operable to produce an original single transmission signal having a predetermined frequency, said frequency generating means further operable to produce a single second harmonic transmission signal of said original transmission signal;

a transmission manifold means, operable to receive said original single transmission signal having a predetermined frequency, and said single second harmonic transmission signal, said transmission manifold further operable to split said original single transmission signal into a multiplicity of distinct, original transmission manifold signals and said transmission manifold means also so operable to split said single second harmonic transmission signal, into a multiplicity of distinct, second harmonic transmission manifold signals;

a multiplicity of dual frequency transmit/receive modules, each of said dual frequency transmit/-receive modules comprising a transmission signal phase shifter said transmission signal phase shifter operable to shift said transmission manifold and said transmission manifold harmonic of said signal a predetermined phase amount, a driver amplifier said driver amplifier operable to amplify said phase shifted transmission manifold signal and said transmission manifold harmonic of said signal, a dual port push-pull Class B power amplifier said dual port push-pull Class B power amplifier being operable to amplify either said phase shifted transmission manifold or said phase shifted transmission manifold harmonic of said signal, a circulator said circulator being operable to provide signal isolation between said transmitted phase shifted amplified transmission manifold and harmonic transmission manifold signals and said received reflected original transmission manifold and second harmonic transmission manifold signals, a local oscillator signal generator said local oscillator signal generator operable to produce a local oscillation signal, a local oscillating signal phase shifter said local oscillating signal phase shifter being operable to phase shift said local oscillation signal, a mixer said mixer operable to combine said local oscillation signal and said received reflected original transmission manifold signal and, a harmonic mixer said harmonic mixer operable to combine said local oscillation signal and said received reflected second harmonic transmission manifold signals;

an antenna means, said antenna means operable to receive from said dual frequency transmit/receive modules said phase shifted and amplified multiplicity of distinct, original transmission manifold signals, and said multiplicity of distinct, second harmonic transmission manifold signals, said antenna means being further operable to receive from said targets located in said environment outside of said active aperture system, said received, reflected distinct original transmission manifold signals or said received, reflected distinct second harmonic transmission manifold signals;

a reception manifold means, said reception manifold means operable to receive from said dual frequency transmit/receive modules said received, reflected, multiplicity of distinct, original transmission manifold signals, and said received, reflected multiplicity of distinct, second harmonic transmission manifold signals, and said reception manifold means being further operable to combine said received reflected, multiplicity of distinct, original transmission manifold signals, and said received, reflected, multiplicity of distinct, second harmonic transmission manifold signals, into a single, combined, received reflected, original transmission manifold signal and a combined, received, second harmonic transmission manifold signal; and a receiver means, said receiver means operable to receive said single, combined, received, reflected, original transmission manifold signal from said dual frequency transmit/receive module and said combined, received, second harmonic transmission manifold signal from said dual frequency transmit/receive module and said receiver means being operable to amplify said combined, received, reflected original transmission and second harmonic transmission manifold signals received from said antenna means as reflected from said targets in said environment outside of said active aperture radar system.

3. A active aperture radar system as in claim 2 in which said dual frequency transmit/receive module further comprises, at least one broad band low noise amplifier, said broad band low noise amplifier operable to receive said received reflected original transmission manifold or said received reflected second harmonic transmission manifold signals from said antenna said broad band low noise amplifier being further operable to amplify said received reflected original or second harmonic transmission manifold signals.

4. A active aperture radar system as in claim 2 in which said dual frequency transmit/receive module further comprises, a first narrow band low noise amplifier, and a second narrow band low noise amplifier said first narrow band low noise amplifier being operable to receive from said antenna said received reflected original transmission manifold signals and said second narrow band low noise amplifier being operable to receive from said antenna said received reflected second harmonic transmission manifold signal, said first and said second narrow band low noise amplifiers being also operable to amplify said received reflected original or second harmonic transmission manifold signals respectively.

5. A dual frequency active aperture radar system, said dual frequency active aperture radar system being operable to generate, transmit and receive a radio frequency signal in at least one frequency and in a harmonic of that same frequency either simultaneously or consecutively, comprising:

a frequency generator operable to generate said radio frequency signal and said frequency generator further operable to generate said harmonic of said radio frequency signal;

a transmission manifold operable to split said radio frequency signal and said harmonic of said radio frequency signal into a multiplicity of distinct but unaltered transmission manifold radio frequency signals and transmission manifold harmonic radio frequency signals;

at least one dual frequency transmit/receive module comprising a transmission signal phase shifter said transmission signal phase shifter operable to shift said transmission manifold radio frequency signal and said transmission manifold harmonic of said radio frequency signal a predetermined phase amount, a driver amplifier said driver amplifier operable to amplify said phase shifted transmission manifold radio frequency signal and said transmission manifold harmonic of said radio frequency signal, a dual port push-pull Class B power amplifier said dual port push-pull Class B power amplifier operable to amplify either said phase shifted transmission manifold radio frequency signal or said transmission manifold harmonic of said radio frequency signal, a circulator said circulator operable to provide signal isolation between said transmitted phase shifted amplified transmission manifold radio frequency and harmonic radio frequency signals and said received reflected distinct original transmission manifold and second harmonic transmission manifold signals, a local oscillator signal generator said local oscillator signal generator operable to produce a local oscillation signal, a local oscillating signal phase shifter said local oscillating signal phase shifter operable to phase shift said local oscillation signal, a mixer said mixer operable to combine said local oscillation signal and said received reflected distinct original transmission manifold signal and a harmonic mixer said harmonic mixer operable to combine said local oscillation signal and said received reflected distinct second harmonic transmission manifold signals;

at least one antenna for each of said dual frequency transmit/receive modules operable to; receive said phase shifted, amplified transmission manifold and said transmission manifold harmonic radio frequency from said dual frequency transmit/receive module, said antenna being also operable to transmit said phase shifted, amplified transmission manifold and said phase shifted, amplified transmission manifold harmonic radio frequency signals towards targets located in the environment outside of said dual frequency active aperture radar system, and said antenna is also operable to receive as reflected radio frequency and harmonic radio frequency signals from said targets located in the environment outside of said dual frequency active aperture radar system, a reception manifold operable to combine said reflected radio frequency signals from said antennas into a single reception manifold radio frequency signal and a single reception manifold harmonic radio frequency signal; and, a receiver operable to receive said single reception manifold radio frequency signal and said single reception manifold harmonic radio frequency signal from said reception manifold, said receiver further operable to amplify said single reception manifold radio frequency signal and said single reception manifold harmonic radio frequency signal for further signal processing and display.

6. A dual frequency transmit/receive module, as in claim 1, wherein said dual frequency transmit/receive module further comprises, at least one broad band low noise amplifier, said broad band low noise amplifier being operable to receive said received reflected original and said harmonically related radio frequency transmission manifold signals from said antenna, said broad band low noise amplifier being further operable to amplify said received reflected first and said harmonically related radio frequency transmission manifold signals from said antenna.

7. A dual frequency transmit/receive module, as in claim 1, wherein said dual frequency transmit/receive module further comprises, a first narrow band low noise amplifier and a second narrow band low noise amplifier, said first narrow band low noise amplifier being operable to receive from said antenna said received reflected original radio frequency transmission manifold signals from said antenna, said second narrow band low noise amplifiers being operable to receive from said antenna said received reflected harmonically related radio frequency transmission manifold signals from said antenna, said first narrow band low noise amplifier and said second narrow band low noise amplifier being both further operable to amplify said received reflected original and harmonically related radio frequency transmission manifold signals from said antenna.

8. A dual frequency transmit/receive module, as in claims 1, 6 or 7, wherein said harmonically related radio frequency signal is a second harmonic of said original radio frequency signal.

9. A dual frequency active aperture radar system as in claim 5, wherein said dual frequency transmit/receive module further comprises; a phase shifter operable to phase shift said transmission manifold and said transmission manifold harmonic radio frequency signals, a duplexer operable to provide signal isolation between said transmission manifold, transmission manifold harmonic radio frequency signals and said received reflected radio frequency and harmonic radio frequency signals, an amplifier said amplifier operable in at least two radio frequencies, a circulator operable to provide signal isolation between said antenna and said dual frequency transmit/receive module, and a low noise amplifier said low noise amplifier operable to amplify said received reflected radio frequency and harmonic radio frequency signals.

10. A dual frequency active aperture radar system as in claim 5, in which said dual frequency transmit/-receive module further comprises, at least one broad band low noise amplifier, said broad band low noise amplifier operable to receive said received reflected distinct original transmission manifold or said received reflected distinct second harmonic transmission manifold signals from said antenna said broad band low noise amplifier being further operable to amplify said received reflected distinct original or second harmonic transmission manifold signals.

11. A dual frequency active aperture radar system as in claim 5, in which said dual frequency transmit/-receive module further comprises, a first narrow band low noise amplifier and a second narrow band low noise amplifier, said first narrow band low noise amplifier being operable to receive from said antenna said received reflected distinct original transmission manifold signals and said second narrow band low noise amplifier being operable to receive from said antenna said received reflected distinct second harmonic transmission manifold signal said first and said second narrow band low noise amplifiers being also operable to amplify said received reflected distinct original or second harmonic transmission manifold signals respectively.

12. A dual frequency transmit/receive module as in claim 5, wherein said dual port push-pull Class B power amplifier further comprises; an input zero to one hundred and eighty degree hybrid, a first field effect transistor, a second field effect transistor, an output zero to one hundred and eight degree hybrid, a first output port said first output port being so operable to transmit an amplified radio frequency signal having an original frequency, and a second output port said second output port being so operable to transmit an amplified radio frequency signal having a harmonic of said original frequency.

* * * * *